US006489077B1

(12) United States Patent
Dickerson et al.

(10) Patent No.: US 6,489,077 B1
(45) Date of Patent: Dec. 3, 2002

(54) PORTAL IMAGING ASSEMBLY WITH PAIR OF ASYMMETRIC SCREENS AND METHOD OF USE

(75) Inventors: Robert E. Dickerson, Hamlin, NY (US); William E. Moore, Macedon, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/894,767

(22) Filed: Jun. 28, 2001

(51) Int. Cl.[7] ..... G03C 1/46; G03C 5/17

(52) U.S. Cl. ..... 430/139; 430/502; 430/509; 430/966; 430/967

(58) Field of Search ..... 430/139, 502, 430/509, 966, 967

(56) References Cited

U.S. PATENT DOCUMENTS

| | | | | |
|---|---|---|---|---|
| 4,994,355 | A | 2/1991 | Dickerson et al. | 430/139 |
| 4,997,750 | A | 3/1991 | Dickerson et al. | 430/139 |
| 5,021,327 | A | 6/1991 | Bunch et al. | 430/139 |
| 5,871,892 | A | 2/1999 | Dickerson et al. | 430/139 |
| 6,190,822 | B1 | 2/2001 | Dickerson et al. | 430/139 |
| 6,200,723 | B1 | 3/2001 | Dickerson et al. | 430/139 |

OTHER PUBLICATIONS

USSN 09/706,977, filed Nov. 6, 2000, Dickerson & Preddy, *High Speed Radiographic Film and Imaging Assembly* (D–81625).

USSN 09/706,981 filed Nov. 6, 2000, Dickerson & Pavlik, *Visually Adaptive Radiographic Film and Imaging Assembly*(D–81626).

USSN 09/707,069 filed Nov. 6, 2000, Dickerson, *Low Silver Radiographic Film and Imaging Assembly for Thoracic Imaging* (D–81627).

USSN 09/707,063 filed Nov. 6, 2000, Dickerson & Bunch, *High Contrast Visually adaptive Radiographic Film and Imaging Assembly for Thoracic Imaging* (D–81630).

USSN 09/731,356 filed Dec. 6, 2000, Dickerson & Moore, *Radiation Oncology Treatment Portal Imaging Film and Method of Use*(D–81631).

USSN 09/731,272 filed Dec. 6, 2000, Dickerson & Dillenbeck, *Radiation Oncology Treatment Localizaton Imaging Film and Method of Use* (D–81632).

Co–pending USSN 09/894,775, Dickerson & Moore, *Asymmetric Contrast Portal Imaging Assembly and Method of Use* (D–82327).

Co–pending USSN 09/894,773, Dickerson & Moore *Asymmetric Speed Portal Imaging Assembly and Method of Use* (D–82328).

Co–pending USSN 09/893,595, Dickerson & Moore, *Portal Imaging Assembly with Asymmetric Films and Asymmetric Screens and Method of Use* (D–82329).

*Primary Examiner*—Richard L. Schilling
(74) *Attorney, Agent, or Firm*—J. Lanny Tucker

(57) ABSTRACT

A radiographic imaging assembly has two different ("asymmetric") fluorescent intensifying screens on either side of two radiographic silver halide films. The two fluorescent intensifying screens differ in speed by at least 0.1 logE. This imaging assembly provides high contrast images and improved exposure latitude for use in various exposure conditions and equipment. The two films can be the same or different (for example, providing images of different contrast).

15 Claims, 1 Drawing Sheet

PORTAL IMAGING ASSEMBLY WITH PAIR OF ASYMMETRIC SCREENS AND METHOD OF USE

FIELD OF THE INVENTION

This invention is directed to radiography in which radiation is aimed at certain regions of a subject to provide therapy treatment. In particular, it is directed to a radiographic portal imaging assembly containing a combination of two radiographic silver halide films and a pair of asymmetric fluorescent intensifying screens and to methods of use. This invention is useful in portal radiography.

BACKGROUND OF THE INVENTION

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5% or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.) and U.S. Pat. No. 4,425,426 (Abbott et al.), U.S. Pat. No. 4,414,310 (Dickerson), U.S. Pat. No. 4,803,150 (Kelly et al.), U.S. Pat. No. 4,900,652 (Kelly et al.), U.S. Pat. No. 5,252,442 (Tsaur et al.), and *Research Disclosure*, Vol. 184, August 1979, Item 18431.

Radiation oncology is a field of radiology relating to the treatment of cancers using high energy X-radiation. This treatment is also known as teletherapy, using powerful, high energy X-radiation machines (often linear accelerators) to exposure the cancerous tissues (tumor). The goal of such treatment is to cure the patient by selectively killing the cancer while minimizing damage to surrounding healthy tissues.

Such treatment is commonly carried out using high energy X-radiation, 4 to 25 MVp. The X-radiation beams are very carefully mapped for intensity and energy. The patient is carefully imaged using a conventional diagnostic X-radiation unit, a CT scanner, and/or an MRI scanner to accurately locate the various tissues (healthy and cancerous) in the patient. With full knowledge of the treatment beam and the patient's anatomy, a dosimetrist determines where and for how long the treatment X-radiation will be directed, and predicts the radiation dose to the patient.

Usually, this treatment causes some healthy tissues to be overexposed. To reduce this effect, the dosimetrist provides one or more custom-designed "blocks" or shields of lead around the patient's body to absorb X-radiation that would impact healthy tissues.

To determine and document that a treatment radiation beam is accurately aimed and is effectively killing the cancerous tissues, two types of imaging are carried out during the course of the treatment. "Portal radiography" is generally the term used to describe such imaging. The first type of portal imaging is known as "localization" imaging in which the portal radiographic film is briefly exposed to the X-radiation passing through the patient with the lead shields removed and then with the lead shields in place. Exposure without the lead shields provides a faint image of anatomical features that can be used as orientation references near the targeted feature while the exposure with the lead shields superimposes a second image of the port area. This process insures that the lead shields are in the correct location relative to the patient's healthy tissues.

Both exposures are made using a fraction of the total treatment dose, usually 1 to 4 monitor units out of a total dose of 45–150 monitor units. Thus, the patient receives less than 20 RAD's of radiation.

If the patient and lead shields are accurately positioned relative to each other, the therapy treatment is carried out using a killing dose of X-radiation administered through the port. The patient typically receives from 50 to 300 RAD's during this treatment. Since any movement of the patient during exposure can reduce treatment effectiveness, it is important to minimize the time required to process the imaged films.

A second, less common form of portal radiography is known as "verification" imaging to verify the location of the cell-killing exposure. The purpose of this imaging is to record enough anatomical information to confirm that the cell-killing exposure was properly aligned with the targeted tissue. The imaging film/cassette assembly is kept in place behind the patient for the full duration of the treatment. Verification films have only a single field (the lead shields are in place) and are generally imaged at intervals during the treatment regime that may last for weeks. Thus, it is important to insure that proper targeted tissue and only that tissue is exposed to the high level radiation because the levels of radiation are borderline lethal.

Portal radiographic imaging film, assembly and methods are described, for example, in U.S. Pat. No. 5,871,892 (Dickerson et al.) in which the same type of radiographic element can be used for both localization and portal imaging.

Portal imaging assemblies can be grouped into two categories. The first type of assemblies includes one or two metal plates and a radiographic silver halide film that is designed for direct exposure to X-radiation. Two such films that are commercially available are KODAK X-ray Therapy Localization (XTL) Film and KODAK X-ray Therapy Verification (XV) Film. Each of these films is generally used with a single copper or lead plate. They have the advantage of having low contrast so that a wide range of exposure conditions can be used to produce useful images. However, because high energy X-radiation is used to produce therapy portal images, the contrast of the imaged tissues (target tissues) is also very low. Coupled with the low contrast of the imaging system, the final image contrast is very low and difficult to read accurately.

The second type of portal imaging assemblies includes a fluorescent intensifying screen and a silver halide radiographic film. These assemblies include one or two metal plates, one or two fluorescent intensifying screens, and a fine grain emulsion film. Because a significant amount of the film's exposure comes from the light emitted by the fluorescent screen(s), it is possible to use films that provide high contrast images. Thus, these imaging assemblies typically provide images having contrast 3.5 times higher than those direct imaging assemblies noted above do. However, the photospeed obtained with both types of assemblies is about the same.

Problem to be Solved

However, the imaging assemblies of the prior art present some problems. Due to their high contrast images and the variations in patient treatment dosages, patient tissue conditions (thickness), and exposing equipment, it is more difficult to obtain correct exposures. The images are either too light or too dark. Exposure can be controlled by adjusting the so-called "air gap" distance between the patient and the imaging system and the monitor setting. Unfortunately, many therapy machines used in therapy imaging (especially therapy verification imaging) do not allow for an adjustable "air gap". This is especially true for therapy verification imaging.

Thus, there is a continuing need in the health imaging industry to provide a highly effective means for portal imaging under a wide variety of exposure conditions. More particularly, there is a need for portal imaging assemblies that provide greater "exposure latitude" without loss of photospeed or contrast. The present invention is directed to solving these problems.

SUMMARY OF THE INVENTION

This invention provides a solution to the noted problems with a radiographic imaging assembly comprising the following components arranged in association, in order:

(a) a first fluorescent intensifying screen, (b) a first radiographic silver halide film, (c) a second radiographic silver halide film, and (d) a second fluorescent intensifying screen, wherein the first and second fluorescent intensifying screens differing in photographic speed by at least 0.1 logE, and the first and second radiographic silver halide films being the same or different, and each comprising a support having first and second major surfaces and is capable of transmitting X-radiation, the first and second radiographic silver halide films having disposed on the first major support surface, one or more hydrophilic colloid layers including at least one silver halide emulsion layer, and on the second major support surface, one or more hydrophilic colloid layers including at least one silver halide emulsion layer, and each of the silver halide emulsion layers comprising silver halide cubic grains that have the same or different composition in each silver halide emulsion layer, and all hydrophilic layers of the first and second radiographic silver halide films being fully forehardened and wet processing solution permeable for image formation within 45 seconds.

Further, this invention provides a method of providing a black-and-white image comprising exposing the radiographic imaging assemblies described above, and processing the first and second radiographic silver halide films, sequentially, with a black-and-white developing composition and a fixing composition, the processing being carried out within 90 seconds, dry-to-dry.

The present invention provides a means for providing high contrast images in portal imaging using a wide variety of therapy imaging machines under a wide variety of conditions. Thus, the present invention provided improved "exposure latitude" and "dynamic range" in this important field of radiology. In addition, all other desirable sensitometric properties are maintained and the first and second films can be rapidly processed in the same conventional processing equipment and compositions.

These advantages are achieved by using two of the same or different radiographic silver halide films that are arranged "in association" with two different fluorescent intensifying screens, meaning they are generally in physical contact with no significant gap between them in the imaging assembly. The two fluorescent intensifying screens differ in photographic speed by at least 0.1 logE and are considered "asymmetric" screens. The two screens are also arranged "in association" with the two radiographic silver halide films. Imaging radiation can be directed first through either fluorescent intensifying screen before it reaches the first and second radiographic silver halide films.

DETAILED DESCRIPTION OF THE INVENTION

Definition of Terms

Figure 1:
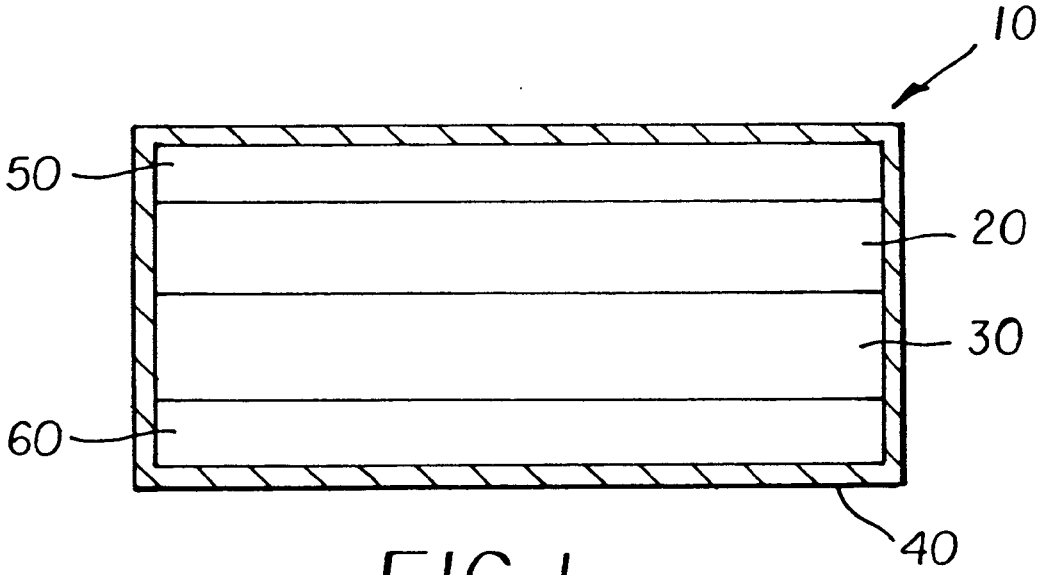
FIG. 1 is a schematic cross-sectional illustration of one embodiment of this invention comprising first and second radiographic silver halide films in a cassette holder with two fluorescent intensifying screens.

The term "contrast" as herein employed indicates the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta\log_{10}E$ ($\log_{10}E_2-\log_{10}E_1$), $E_1$ and $E_2$ being the exposure levels at the reference points (1) and (2).

"Gamma" is described as the instantaneous rate of change of a D logE sensitometric curve or the instantaneous contrast at any logE value.

"Peak gamma" is the point of the sensitometric curve where the maximum gamma is achieved.

Photographic "speed" refers to the exposure necessary to obtain a density of at least 1.0 plus $D_{min}$.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" is employed to indicate dry-to-dry processing of a radiographic film in 45 seconds or less. That is, 45 seconds or less elapse from the time a dry imagewise exposed radiographic film enters a wet processor until it emerges as a dry fully processed film.

In referring to grains and silver halide emulsions containing two or more halides, the halides are named in order of ascending concentrations.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as 100 times the standard deviation (a) of grain ECD divided by the mean grain ECD.

The term "covering power" is used to indicate 100 times the ratio of maximum density to developed silver measured in $mg/dm^2$.

The term "dual-coated" is used to define a radiographic film having silver halide emulsion layers disposed on both the front- and backsides of the support. The radiographic silver halide films used in the present invention are "dual-coated."

The term "RAD" is used to indicate a unit dose of absorbed radiation, that is energy absorption of 100 ergs per gram of tissue.

The term "portal" is used to indicate radiographic imaging, films and intensifying screens applied to mega-voltage radiotherapy conducted through an opening or port in a radiation shield.

The term "localization" refers to portal imaging that is used to locate the port in relation to the surrounding anatomy of the irradiated subject. Typically exposure times range from 1 to 10 seconds.

The term "verification" refers to portal imaging that is used to record patient exposure through the port during radiotherapy. Typically exposure times range from 30 to 300 seconds.

The term "exposure latitude" refers to the width of the gamma/logE curves for which contrast values were greater than 1.5.

The term "dynamic range" refers to the range of exposures over which useful images can be obtained (usually those having a gamma of at least 2).

The term "crossover" as herein employed refers to the percentage of light emitted by a fluorescent intensifying screen that strikes a dual-coated radiographic film and passes through its support to reach the image forming layer unit disposed on the opposite side of the support. Crossover can be determined as described in U.S. Pat. No. 4,425,426 (Abbott et al.).

The terms "kVp" and "MVp" stand for peak voltage applied to an X-ray tube times $10^3$ and $10^6$, respectively.

The term "fluorescent intensifying screen" refers to a screen that absorbs X-radiation and emits light. A "prompt" emitting fluorescent intensifying screen will emit light immediately upon exposure to radiation while "storage" fluorescent screen can "store" the exposing X-radiation for emission at a later time when the screen is irradiated with other radiation (usually visible light).

The term "metal intensifying screen" refers to a metal screen that absorbs MVp level X-radiation to release electrons and absorbs electrons that have been generated by X-radiation prior to reaching the screen.

The terms "front" and "back" refer to layers, films, or intensifying screens nearer to and farther from, respectively, the X-radiation source.

The term "rare earth" is used to indicate chemical elements having an atomic number of 39 or 57 through 71.

*Research Disclosure* is published by Kenneth Mason Publications, Ltd., Dudley House, 12 North St., Emsworth, Hampshire P010 7DQ England.

The present invention uses two radiographic silver halide films in the imaging assembly to achieve the desired advantages. The two films can be identical in construction or properties. Alternatively, the two films can differ in construction and properties, and preferably provide images that exhibit different contrast. For example, the "first" film can be a "high contrast" radiographic silver halide film while the "second" film can be a "lower contrast" radiographic silver halide film because the contrast of images it provides is lower than that of images provided by the "first" film.

For example, in such embodiments where the two films provide images having different contrasts, the ratio of contrast of an image provided by the first radiographic silver halide film image to the contrast of an image provided by the second radiographic silver halide film image can be at least 1.25 and preferably at least 1.75. More preferably, this ratio is from about 2 to about 2.5. As is well known, contrast can be adjusted in various radiographic silver halide films in various ways, for example by using different levels of dopants (or none at all in one film), by adjusting silver coverage, or by blending emulsions having different sensitivities. One skilled in the art would have the skill and knowledge to prepare first and second radiographic silver halide films that provide images having the noted contrast difference.

The following discussion will be directed to features useful in both first and second films unless otherwise noted.

The radiographic silver halide films useful in this invention include a flexible support having disposed on both sides thereof, one or more photographic silver halide emulsion layers and optionally one or more non-radiation sensitive hydrophilic layer(s). The silver halide emulsions in the various layers can be the same or different in the first or second films, and can comprise mixtures of various silver halide emulsions in one or more of the layers.

In preferred embodiments, each first or second film has the same silver halide emulsions on both sides of the support. It is also preferred that each film have a protective overcoat (described below) over the silver halide emulsions on each side of the support.

The support can take the form of any conventional radiographic film support that is X-radiation and light transmissive. Useful supports for the films of this invention can be chosen from among those described in *Research Disclosure*, September 1996, Item 38957 XV. Supports and *Research Disclosure*, Vol. 184, August 1979, Item 18431, XII. Film Supports.

The support is preferably a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure*, Item 38957, Section XV Supports, cited above, attention is directed particularly to paragraph (2) that describes subbing layers, and paragraph (7) that describes preferred polyester film supports.

In the more preferred embodiments, at least one non-light sensitive hydrophilic layer is included with the one or more silver halide emulsion layers on each side of the film support. This layer may be called an interlayer or overcoat, or both.

The silver halide emulsion layers comprise one or more types of silver halide grains responsive to X-radiation. Silver halide grain compositions particularly contemplated include those having at least 50 mol % chloride (preferably at least 70 and more preferably at least 80 mol % chloride), and up to 50 mol % bromide, based on total silver in a given emulsion layer. Such emulsions include silver halide grains composed of, for example, silver chloride, silver iodochloride, silver bromochloride, silver iodobromochloride, and silver bromoiodochloride. Iodide is generally limited to no more than 2 mol % (based on total silver in the emulsion layer) to facilitate more rapid processing. Preferably iodide is from about 0.5 to about 1.5 mol % (based on total silver in the emulsion layer) or eliminated entirely from the grains. The silver halide grains in each silver halide emulsion unit (or silver halide emulsion layers) can be the same or different, or mixtures of different types of grains.

The silver halide grains useful in this invention can have any desirable morphology including, but not limited to, cubic, octahedral, tetradecahedral, rounded, spherical or other non-tabular morphologies, or be comprised of a mixture of two or more of such morphologies. Preferably, the grains in each silver halide emulsion independently have cubic morphology.

It may also be desirable to employ silver halide grains that exhibit a coefficient of variation (COV) of grain ECD of less than 20% and, preferably, less than 10%. In some embodiments, it may be desirable to employ a grain population that is as highly monodisperse as can be conveniently realized.

The average silver halide grain size can vary within each radiographic silver halide film, and within each emulsion layer within that film. For example, the average grain size in each radiographic silver halide film is independently and generally from about 0.1 to about 0.3 $\mu$m (preferably from about 0.1 to about 0.2 $\mu$m), but the average grain size can be different in the various emulsion layers.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure*, Item 38957, cited above, Section I. Emulsion grains and their preparation, sub-section D. Grain modifying conditions and adjustments, paragraphs (3), (4), and (5).

Preferably, the emulsions used in the first radiographic silver halide film are doped with any of conventional rhodium dopants to increase the contrast. These dopants can be present in an amount of from about $1\times10^{-5}$ to about $5\times10^{-5}$ mole per mole of silver in each emulsion layer, and preferably at from about $2\times10^{-5}$ to about $4\times10^{-5}$ mol/mol Ag in each emulsion layer. The amount of rhodium dopant can be the same or different in the various emulsion layers.

Useful rhodium dopants are well known in the art and are described for example in U.S. Pat. No. 3,737,313 (Rosecrants et al.), U.S. Pat. No. 4,681,836 (Inoue et al.), and U.S. Pat. No. 2,448,060 (Smith et al.). Representative rhodium dopants include, but are not limited to, rhodium halides (such as rhodium monochloride, rhodium trichloride, diammonium aquapentachlororhodate, and rhodium ammonium chloride), rhodium cyanates {such as salts of $[Rh(CN)_6]^{-3}$, $[RhF(CN)_5]^{-3}$, $[RhI_2(CN)_4]^{-3}$ and $[Rh(CN)_5(SeCN)]^{-3}$}, rhodium thiocyanates, rhodium selenocyanates, rhodium tellurocyanates, rhodium azides, and others known in the art, for example as described in *Research Disclosure*, Item 437013, page 1526, September 2000 and publications listed therein, all incorporated herein by reference. The preferred rhodium dopant is diammonium aquapentachlororhodate. Mixtures of dopants can be used also.

A general summary of silver halide emulsions and their preparation is provided by *Research Disclosure*, Item 38957, cited above, Section I. Emulsion grains and their preparation. After precipitation and before chemical sensitization the emulsions can be washed by any convenient conventional technique using techniques disclosed by *Research Disclosure*, Item 38957, cited above, Section III. Emulsion washing.

The emulsions can be chemically sensitized by any convenient conventional technique as illustrated by *Research Disclosure*, Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

The first and second radiographic silver halide films can also include varying amounts of appropriate spectral sensitizing dyes. Dyes useful for this purpose are well known and include, for example, cyanine and merocyanine dyes, including the benzimidazolocarbocyanine dyes described in U.S. Pat. No. 5,210,014 (Anderson et al.), incorporated herein by reference. The useful amounts of such dyes are well known in the art but generally within the range of from about 200 to about 1000 mg/mole of silver in the emulsion layer.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds include, but are not limited to, 5-mercapotetrazoles, dithioxotriazoles, mercapto-substituted tetraazaindenes, and others described in U.S. Pat. No. 5,800,976 (Dickerson et al.) that is incorporated herein by reference for the teaching of the sulfur-containing covering power enhancing compounds.

The silver halide emulsion layers and other hydrophilic layers on both sides of the support of the first and second radiographic films generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al.), incorporated herein by reference.

The silver halide emulsion layers (and other hydrophilic layers) in the first and radiographic films are generally fully hardened using one or more conventional hardeners. Thus, the amount of hardener in each silver halide emulsion and other hydrophilic layer is generally at least 2% and preferably at least 2.5%, based on the total dry weight of the polymer vehicle in each layer.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxy-dihydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (for example, mucochloric and mucobromic acids), onium-substituted acroleins, vinyl sulfones containing other hardening functional groups, polymeric hardeners such as dialdehyde starches, and poly (acrolein-co-methacrylic acid).

The levels of silver and polymer vehicle in each radiographic silver halide film used in the present invention are not critical except that the levels can be adjusted to provide the desired difference in contrast between the first and second radiographic silver halide films. In general, the level of silver on each side of each film is at least 9 and no more than 15 mg/dm$^2$. In addition, the total coverage of polymer vehicle on each side of each film is generally at least 30 and no more than 36 mg/dm$^2$. The amounts of silver and polymer vehicle on the two sides of the support in each radiographic silver halide film can be the same or different. These amounts refer to dry weights.

The first and second radiographic films generally include a surface protective overcoat on each side of the support that is typically provided for physical protection of the emulsion layers. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure*, Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of protective overcoat addenda, such as anti-matte particles, in the interlayers. The overcoat on at least one side of the support can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers. Protective overcoats are provided to perform two basic functions. They provide a layer between the emulsion layers and the surface of the film for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

The various coated layers of radiographic silver halide films used in this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

The radiographic imaging assemblies of the present invention are composed of the first and second radiographic silver halide films as described herein and first and second fluorescent intensitying screens that have different photographic speed. The fluorescent intensifying screens differ in speed by at least 0.1 logE, preferably by at least 0.2 logE, and more preferably by at least 0.3 logE. Such screens can be designed to have different speeds using well known technology including different amounts or types of phosphors, or different phosphor particle sizes. One skilled in the art would readily know how to design screens of different speed. The following discussion relates to fluorescent intensifying screens in general.

Fluorescent intensifying screens are typically designed to absorb X-rays and to emit electromagnetic radiation having a wavelength greater than 300 nm. These screens can take any convenient form providing they meet all of the usual requirements for use in radiographic imaging. Examples of conventional, useful fluorescent intensifying screens are provided by *Research Disclosure*, Item 18431, cited above, Section IX. X-Ray Screens/Phosphors, and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains phosphor particles and a binder, optimally additionally containing a light scattering material, such as titania.

Any conventional or useful phosphor can be used, singly or in mixtures, in the intensifying screens used in the practice of this invention. For example, useful phosphors are described in numerous references relating to fluorescent intensifying screens, including but not limited to, *Research Disclosure*, Vol. 184, August 1979, Item 18431, Section IX, X-ray Screens/Phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP-A-0,491,116 (Benzo et al.), the disclosures of all of which are incorporated herein by reference with respect to the phosphors.

Useful classes of phosphors include, but are not limited to, calcium tungstate ($CaWO_4$), activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described for example in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference.

Some preferred rare earth oxychalcogenide and oxyhalide phosphors are represented by the following formula (1):

$$M'_{(w-n)}M''_nO_wX' \quad (1)$$

wherein M' is at least one of the metals yttrium (Y), lanthanum (La), gadolinium (Gd), or lutetium (Lu), M" is at least one of the rare earth metals, preferably dysprosium (Dy), erbium (Er), europium (Eu), holmium (Ho), neodymium (Nd), praseodymium (Pr), samarium (Sm), tantalum (Ta), terbium (Tb), thulium (Tm), or ytterbium (Yb), X' is a middle chalcogen (S, Se, or Te) or halogen, n is 0.002 to 0.2, and w is 1 when X' is halogen or 2 when X' is a middle chalcogen. These include rare earth-activated lanthanum oxybromides, and terbium-activated or thulium-activated gadolinium oxides such as $Gd_2O_2S$:Tb.

Other suitable phosphors are described in U.S. Pat. No. 4,835,397 (Arakawa et al.) and U.S. Pat. No. 5,381,015 (Dooms), both incorporated herein by reference, and including for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting and/or storage phosphors [particularly those containing iodide such as alkaline earth metal fluorobromoiodide storage phosphors as described in U.S. Pat. No. 5,464,568 (Bringley et al.), incorporated herein by reference].

Another class of phosphors includes a rare earth host and are rare earth activated mixed alkaline earth metal sulfates such as europium-activated barium strontium sulfate.

Particularly useful phosphors are those containing doped or undoped tantalum such as $YTaO_4$, $YTaO_4$:Nb, Y(Sr)$TaO_4$, and Y(Sr)$TaO_4$:Nb. These phosphors are described in U.S. Pat. No. 4,226,653 (Brixner), U.S. Pat. No. 5,064,729 (Zegarski), U.S. Pat. No. 5,250,366 (Nakajima et al.), and U.S. Pat. No. 5,626,957 (Benso et al.), all incorporated herein by reference.

Other useful phosphors are alkaline earth metal phosphors that can be the products of firing starting materials comprising optional oxide and a combination of species characterized by the following formula (2):

$$MFX_{1-z}I_zuM^aX^a{:}yA{:}eQ{:}tD \quad (2)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Tb), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$,:$Nb_2O_5$, $Ta_2O_5$, or $ThO_2$, "D"(V), chromium (Cr), manganese (Mn), iron (Fe), cobalt (Co), or nickel (Ni). The numbers in the noted formula are the following: "z" is 0 to 1, "u" is from 0 to 1, "y" is from $1\times10^{-4}$ to 0.1, "e" is form 0 to 1, and "t"is from 0 to 0.01. These definitions apply wherever they are found in this application unless specifically stated to the contrary. It is also contemplated that "M", "X", "A", and "D" represent multiple elements in the groups identified above.

Storage phosphors can also be used in the practice of this invention. Various storage phosphors are described for example, in U.S. Pat. No. 5,464,568 (noted above), incorporated herein by reference. Such phosphors include divalent alkaline earth metal fluorohalide phosphors that may contain iodide are the product of firing an intermediate, comprising oxide and a combination of species characterized by the following formula (3):

$$(Ba_{1-a-b-c}Mg_aCa_bSr_c)FX_{1-z}I_zrM^aX^a{:}yA \quad (3)$$

wherein X, $M^a$, $X^a$, A, z, and y have the same meanings as for formula (2) and the sum of a, b, and c is from 0 to 4, and r is from $10^{-6}$ to 0.1. Some embodiments of these phosphors are described in more detail in U.S. Pat. No. 5,464,568 (noted above).

Still other storage phosphors are described in U.S. Pat. No. 4,368,390 (Takahashi et al.), incorporated herein by reference, and include divalent europium and other rare earth activated alkaline earth metal halides and rare earth element activated rare earth oxyhalides, as described in more detail above.

Examples of useful phosphors include: SrS:Ce,SM, SrS:Eu,Sm, $ThO_2$:Er, $La_2O_2S$:Eu,Sm, ZnS:Cu,Pb, and others described in U.S. Pat. No. 5,227,253 (Takasu et al.), incorporated herein by reference.

A variety of such screens are commercially available from several sources including by not limited to, LANEX™, X-SIGHT™ and InSight™ Skeletal screens available from Eastman Kodak Company.

Figure 2:
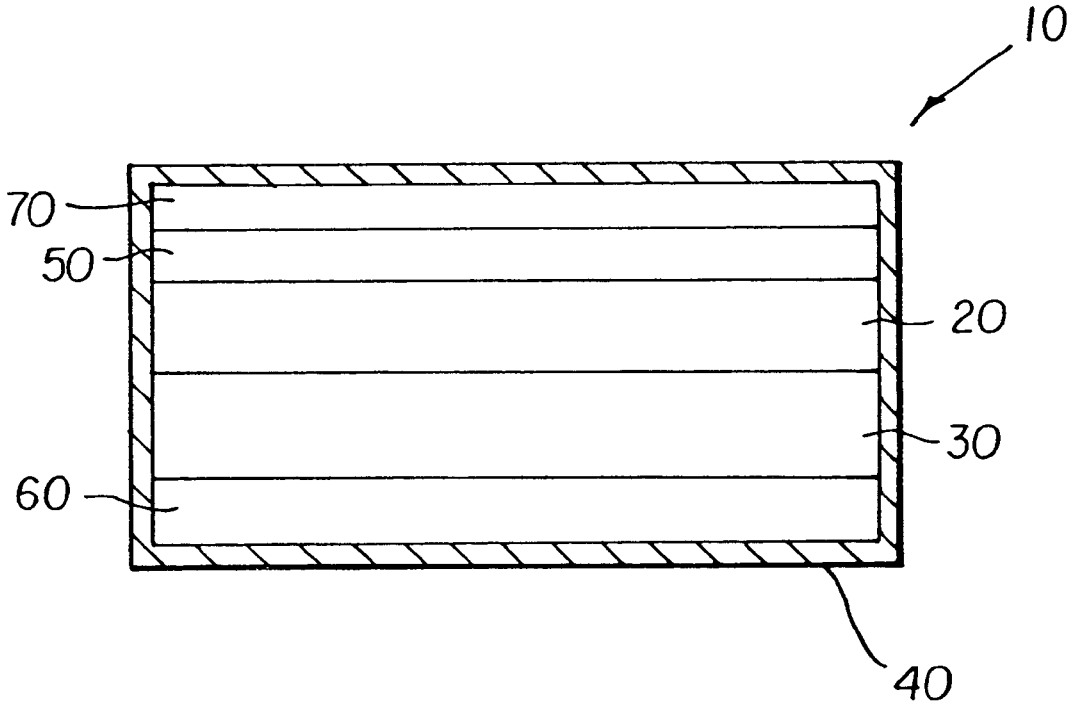
FIG. 2 is a schematic cross-sectional illustration of another embodiment of this invention comprising first and second radiographic silver halide films, two intensifying screens, and a metal screen in a cassette holder.

Two embodiments of the present invention are illustrated in FIGS. 1 and 2. In reference to the imaging assembly 10 shown in FIG. 1, first radiographic silver halide film 20 is arranged in association with second radiographic silver halide film 30 in cassette holder 40, along with fluorescent intensifying screens 50 and 60, the first being in the "front" of imaging assembly 10 and the other being in the "back". FIG. 2 also shows the presence of metal intensifying screen 70 in the front of fluorescent intensifying screen 50.

The metal intensifying screens can also be used in the practice of this invention, or included within the radiographic imaging assemblies of the invention. Metal intensifying screens can also take any convenient conventional form. While the metal intensifying screens can be formed of many different types of materials, the use of metals is most common, since metals are most easily fabricated as thin foils, often mounted on radiation transparent backings to facilitate handling. Convenient metals for screen fabrication are in the atomic number range of from 22 (titanium) to 82 (lead). Metals such as copper, lead, tungsten, iron and tantalum have been most commonly used for screen fabrication with lead and copper in that order being the most commonly employed metals. Generally the higher the atomic number, the higher the density of the metal and the greater its ability to absorb MVp X-radiation.

Exposure and processing of the first and second radiographic silver halide films can be undertaken in any convenient conventional manner. The exposure and processing techniques of U.S. Pat. No. 5,021,327 and U.S. Pat. No. 5,576,156 (both noted above) are typical for processing radiographic films. Other processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multi-part formulations, and in concentrated form or as more diluted working strength solutions. Thus, both first and second radiographic silver halide films can be similarly processed, and preferably processed using the same processing compositions and conditions.

It is particularly desirable that the first and second radiographic silver halide films be processed within 90 seconds ("dry-to-dry") and preferably within 45 seconds and at least 20 seconds, for the developing, fixing and any washing (or rinsing) steps. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al) and EP-A-0 248,390 (Akio et al). Preferably, the black-and-white developing compositions used during processing are free of any gelatin hardeners, such as glutaraldehyde.

Since rapid access processors employed in the industry vary in their specific processing cycles and selections of processing compositions, the preferred radiographic films satisfying the requirements of the present invention are specifically identified as those that are capable of dry-to-dye processing according to the following reference conditions:

| | |
|---|---|
| Development | 11.1 seconds at 35° C., |
| Fixing | 9.4 seconds at 35° C., |
| Washing | 7.6 seconds at 35° C., |
| Drying | 12.2 seconds at 55–65° C. |

Any additional time is taken up in transport between processing steps. Typical black-and-white developing and fixing compositions are described in the Example below.

Radiographic kits of the present invention can include a radiographic imaging assembly of this invention, one or more metal screens, and/or one or more suitable processing compositions (for example black-and-white developing and fixing compositions). Preferably, the kit includes all of these components.

In practicing the therapy imaging method of this invention, X-radiation, typically of from about 4 to about 25 MVp, is directed at a region of the subject (that is, patient) containing features to be identified by different levels of X-radiation absorption. This exposed region is generally somewhat larger than the radiotherapy target area for the purpose of obtaining a discernible image of anatomy reference features outside the targeted area. Thus, a first image is created in the one of the radiographic films (for example, the first radiographic film) as the X-radiation penetrates the subject.

A shield containing a port is generally placed between the subject and the source of X-radiation, and X-radiation is again directed at the subject, this time through the portal, thereby creating a second image through the port that is superimposed on the first image in the first exposed radiographic film. The total exposure during these steps A and B for localization imaging is generally limited to 10 seconds or less.

The first and second radiographic films, the first and second fluorescent intensifying screens, and optional metal screens can be assembled and used in a cassette as is well known in the art.

EXAMPLE

Radiographic Film A

Radiographic Film A is a high contrast film. It was a dual coated film having the same silver halide emulsion on both sides of a blue-tinted 178 μm transparent poly(ethylene terephthalate) film support. The emulsions were chemically sensitized with sodium thiosulfate, potassium tetrachloroaurate, sodium thiocyanate, and potassium selenocyanate and spectrally sensitized with 350 mg/mole of Ag with the S-1 dye shown below.

Radiographic Film A had the following layer arrangement on each side of the film support:

Overcoat

Interlayer

Emulsion Layer

The noted layers were prepared from the following formulations.

| | Coverage (mg/dm$^2$) | |
|---|---|---|
| Overcoat Formulation | | |
| Gelatin vehicle | 3.4 | |
| Methyl methacrylate matte beads | 0.14 | |
| Carboxymethyl casein | 0.57 | |
| Colloidal silica (LUDOX AM) | 0.57 | |
| Polyacrylamide | 0.57 | |
| Chrome alum | 0.025 | |
| Resorcinol | 0.058 | |
| Whale oil lubricant | 0.15 | |
| Interlayer Formulation | | |
| Gelatin vehicle | 3.4 | |
| Carboxymethyl casein | 0.57 | |
| Colloidal silica (LUDOX AM) | 0.57 | |
| Polyacrylamide | 0.57 | |
| Chrome alum | 0.025 | |
| Resorcinol | 0.058 | |
| Nitron | 0.044 | |
| Emulsion Layer Formulation | | |
| Cubic grain emulsion [AgClBr(70:30 halide ratio)0.25 μm average size] | 11.5 | |
| Diammonium aquapentachlororhodate | $3.89 \times 10^{-5}$ | mol/Ag mole |
| Spectral sensitizing dye S-1 (shown below) | 350 | mg/Ag mole |
| Gelatin vehicle | 33 | |
| 2-Carboxy-4-hydroxy-6-methyl-1,3,3a,7-tetraazaindene | 2.1 | g/Ag mole |
| 1-(3-acetamidophenyl)-5-mercaptotetrazole | 0.12 | |
| Ethylenediamine tetraacetic acid, disodium salt | 0.22 | |
| Bisvinylsulfonylmethylether | 2.4% | based on total gelatin in all layers on that side |

Radiographic Film B

Radiographic Film B was commercially available KODAK X-ray Therapy Localization (XTL) Film used in radiation therapy imaging.

Radiographic Film C

Radiographic Film C is a "lower contrast" film that had the following layer arrangement and formulations on both sides of the film support:

Overcoat
Interlayer
Emulsion Layer

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer Formulation | |
| Cubic grain emulsion [AgClBrI (90:9:1 halide ratio) 0.15 $\mu$m average size] | 11.5 |
| Gelatin vehicle | 26 |
| 2-Carboxy 4-hydroxy-6-methyl-1,3,3a,7-tetraazaindene | 2.1 g/Ag mole |
| 1-(3-Acetamidophenyl)-5-mercaptotetrazole | 0.012 |
| Spectral sensitizing dye S-1 (shown below) | 250 mg/Ag mole |
| Ethylenediaminetetraacetic acid, disodium salt | 0.22 |
| Bisvinylsulfonylmethlyether | 2.4% based on total gelatin in all layers on that side |

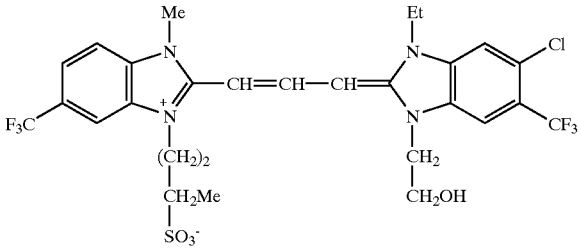

S-1

The cassettes used in the practice of this invention were those commonly used in localization imaging. It comprised a 1 mm thick copper front metal screen and two fluorescent intensifying screens, one in the front and the other in the back of the two radiographic silver halide films.

Screen "W" is a commercially available LANEX Fast back fluorescent intensifing screen. It comprised a terbium activated gadolinium oxysulfite phosphor having a medium particle size was 7 $\mu$m and dispersed in a PERMUTHANE polyurethane binder (phosphor at 13.3 g/dm$^2$, 19:1 phosphor to binder ratio) on a white pigmented polyester support.

Screen "X" is a commercially available LANEX MinR Medium fluorescent intensifying screen. It comprised a terbium activated gadolinium oxysulfide phosphor having a medium particle size of 5–6 $\mu$m and dispersed in a PERMUTHANE polyurethane binder (phosphor at 3.1 g/dr$^2$, 19:1 phosphor to binder ratio) on a white pigmented polyester support.

Screen "Y" is commercially available LANEX Regular general purpose fluorescent intensifying screen. It comprised a terbium activated gadolinium oxysulfide phosphor having a medium particle size of 7 $\mu$m and dispersed in a PERMUTHANE polyurethane binder (phosphor at 7 g/dm$^2$, 15:1 phosphor to binder ratio) on a white pigmented polyester support.

The photographic speed of the various fluorescent intensifying screens are as follows: Screen W is 180 speed, Screen X is 40 speed, and Screen Y is 100 speed wherein Screen 100 has been arbitrarily assigned a photographic speed (light emission) of 100 for 6 MVp X-radiation exposure.

All samples of Radiographic Films A, B, and C, alone or in combination, were exposed using an inverse square X-ray sensitometer. This is a device that makes exceedingly reproducible exposures. A lead screw moves the detector between exposures. By use of the inverse square law, distances are selected that produce exposures that differ by 0.100 logE. The length of the exposures is a constant. With this instrument, we can obtain sensitometry that gives the response of the detector to an imagewise exposure. The image is exposed for the same length of time but the intensity changes due to the anatomy transmitting more or less of the X-radiation flux.

The inverse square X-ray sensitometer was set to make exposures at 100 kVp with 0.5 mm of copper and 1 mm aluminum added filtration. While this is not the same energy created by a radiation therapy treatment machine, it is suitable for demonstrating that one can control exposure latitude while maintaining excellent image contrast.

A worker skilled in the art would understand that at the energies used in radiation therapy, X-radiation uniformly stimulates the fluorescent intensifying screens throughout their thickness. They will also recognize that at the conditions used in this example, not all fluorescent intensifying screens will be uniformly illuminated throughout their thickness. This difference is not of a fundamental importance as the teaching herein is directly applicable to any X-radiation energy, including those lower than 100 kVp as well as those commonly used in radiation therapy.

Processing of the exposed film samples for sensitometric evaluation was carried out using a processor commercially available under the trademark KODAK RP X-OMAT film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were in contact with the developer in each instance for less than 90 seconds. Fixing was carried out using KODAK RP X-OMAT LO Fixer and Replenisher fixing composition (Eastman Kodak Company).

Rapid processing has evolved over the last several years as a way to increase productivity in busy hospitals without compromising image quality or sensitometric response. Where 90-second processing times were once the standard, below 40-second processing is becoming the standard in medical radiography. One such example of a rapid processing system is the commercially available KODAK Rapid Access (RA) processing system that includes a line of X-radiation sensitive films available as T-MAT-RA radiographic films that feature fully forehardened emulsions in order to maximize film diffusion rates and minimize film drying. Processing chemistry for this process is also available. As a result of the film being fully forehardened, glutaraldehyde (a common hardening agent) can be removed from the developer solution, resulting in ecological and safety advantages (see KODAK KWIK Developer below). The developer and fixer designed for this system are Kodak X-OMAT RA/30 chemicals. A commercially available processor that allows for the rapid access capability is the Kodak X-OMAT RA 480 processor. This processor is capable of running in 4 different processing cycles. "Extended" cycle is for 160 seconds, and is used for mammography where longer than normal processing results in higher speed and contrast. "Standard" cycle is 82 seconds, "Rapid Cycle" is 55 seconds and "KWIK/RA" cycle is 40 seconds (see KODAK KWIK Developer below). The KWIK cycle uses the RA/30 processing compositions while the longer time cycles use standard commercially available RP X-OMAT compositions. The following Table I shows typical processing times (seconds) for these various processing cycles.

TABLE I

| Cycle | Extended | Standard | Rapid | KWIK |
|---|---|---|---|---|
| Black-and-white Development | 44.9 | 27.6 | 15.1 | 11.1 |
| Fixing | 37.5 | 18.3 | 12.9 | 9.4 |
| Washing | 30.1 | 15.5 | 10.4 | 7.6 |
| Drying | 47.5 | 21.0 | 16.6 | 12.2 |
| Total | 160.0 | 82.4 | 55 | 40.3 |

The black-and-white developing composition useful for the KODAK KWIK cycle contains the following components:

| | |
|---|---|
| Hydroquinone | 32 g |
| 4-Hydroxymethyl-4-methyl-1-phenyl-3-pyrazolidone | 6 g |
| Potassium bromide | 2.25 g |
| 5-Methylbenzotriazole | 0.125 g |
| Sodium sulfite | 160 g |
| Water to 1 liter, pH 10.35 | |

TABLE II

| Film | Relative Speed | Contrast | Image Quality | Drying KWIK Cycle |
|---|---|---|---|---|
| A | 100 | 5.6 | Excellent | 50% |
| B** | 100 | 1.6 | Good | 100% |
| C | 100 | 2.6 | Good | 50% |

Optical densities are expressed below in terms of diffuse density as measured by a conventional X-rite Model 310 TM densitometer that was calibrated to ANSI standard PH 2.19 and was traceable to a National Bureau of Standards calibration step tablet. The characteristic D vs. logE curve was plotted for each radiographic film that was imaged and processed. Speed was measured at a density of $1.4+D_{min}$. Gamma (contrast) is the slope of the noted curves. The results are shown in TABLE II below.

The "% Drying" was determined by feeding an exposed film flashed to result in a density of 1.0 into an X-ray processing machine in the KODAK KWIK cycle. As the film just exits the drier section, the processing machine was stopped and the film was removed. Roller marks from the processing machine can be seen on the film where the film has not yet dried. Marks from 100% of the rollers in the drier indicate the film has just barely dried. Values less than 100% indicate the film was dried partway into the drier. The lower the value the better the film is for drying.

** Film B was a direct exposure radiographic film (no screen needed). It is well known in the art that the contrast of such a film is 2.3 times (net density) up to about 0.25 $D_{max}$.

As can be seen from the data in TABLE II, Film A provided excellent image quality as a result of very high contrast. It also dried very quickly in the ultra-rapid KODAK KWIK cycle processing. However, due to the high contrast, it does not have much exposure latitude and is difficult to use when therapy machines of fixed film/focal length are used or when exposure settings are not sufficiently fine enough to get the proper exposure.

Film B provided reasonable image quality and exposure but cannot be processed in the KODAK KWIK cycle process. Film C provided good image quality and acceptable exposure latitude and was processable in the KODAK KWIK cycle processing.

The lower limit of exposure latitude corresponds to a contrast of 1.5, which occurs here at logE=0.85. The upper limit on latitude is reached when the density is 3.0. Above 3.0, the image is too dark to be read effectively. This density is reached at logE=1.25. Thus, the change in logE is about 0.4, producing an exposure latitude of 2.5:1. The results of exposure latitude (gamma>2.0 in units of logE) and dynamic range (relative to direct Film B) with individual or combinations of films, and the combination of first and second films, with first and second fluorescent intensifying screens according to the present invention are shown in TABLE III below.

TABLE III

| Film | First Intensifying Screen | Second Intensifying Screen | Exposure Latitude | Dynamic Range |
|---|---|---|---|---|
| A | Y | Y | 0.7 | 2X |
| B | None | None | 0.4 | 1X |
| C | Y | Y | 0.9 | 3.2X |
| A + A | Y | Y | 0.9 | 3.2X |
| A + A | W | X | 1.1 | 5X |
| C + C | Y | Y | 1.0 | 4X |
| C + C | W | X | 1.2 | 6.3X |

The results in TABLE III indicate an increase in exposure latitude and dynamic range were provided according to the present invention when two samples of Films A were used in combination with two different (asymmetric) fluorescent intensifying screens (W and X) in an imaging assembly compared to using the same screens. Greater increases in exposure latitude and relative dynamic range were achieved by using asymmetric screens (W and X) with two samples of Film C that has lower contrast than Film C.

The invention has been described in detail with particular reference to preferred embodiments thereof, but it will be understood that variations and modifications can be effected within the spirit and scope of the invention.

We claim:

1. A radiographic imaging assembly comprising the following components arranged in association, in order:

(a) a first fluorescent intensifying screen, (b) a first radiographic silver halide film, (c) a second radiographic silver halide film, and (d) a second fluorescent intensifying screen, wherein said first and second fluorescent intensifying screens differing in photographic speed by at least 0.1 logE, and said first and second radiographic silver halide films being the same or different, and each comprising a support having first and second major surfaces and is capable of transmitting X-radiation, said first and second radiographic silver halide films having disposed on said first major support surface, one or more hydrophilic colloid layers including at least one silver halide emulsion layer, and on said second major support surface, one or more hydrophilic colloid layers including at least one silver halide emulsion layer, and each of the silver halide emulsion layers comprising silver halide cubic grains that have the same or different composition in each silver halide emulsion layer, and all hydrophilic layers of said first and second radiographic silver halide films being fully forehardened and wet processing solution permeable for image formation within 45 seconds.

2. The imaging assembly of claim 1 wherein said cubic silver halide grains of said silver halide emulsions in said first and second radiographic silver halide films are independently composed of at least 50 mol % chloride based on total silver in the emulsion.

3. The imaging assembly of claim 2 wherein said cubic silver halide grains of said silver halide emulsions in said first and second radiographic silver halide films are independently composed of at least 80 mol % chloride based on total silver in the emulsion, and from about 0.5 to about 1.5 mol % iodide, based on total silver in the emulsion.

4. The imaging assembly of claim 1 wherein the cubic silver halide grains of each silver halide emulsion in said first radiographic silver halide film have the same composition.

5. The imaging assembly of claim 1 wherein said first and second radiographic silver halide films are the same.

6. The imaging assembly of claim 1 wherein said first and second radiographic silver halide films are different, and the ratio of the contrast of an image provided by said first radiographic silver halide film to the contrast of an image provided by said second radiographic silver halide film is at least 1.25.

7. The imaging assembly of claim 1 wherein both said first and second films further comprise an overcoat over said silver halide emulsion on each side of their film supports.

8. The imaging assembly of claim 1 wherein each of said first and second radiographic silver halide films independently comprises a polymer vehicle on each side of its support in a total amount of from about 9 to about 15 $mg/dm^2$ and a level of silver on each side of from about 30 to about 36 $mg/dm^2$.

9. The imaging assembly of claim 1 wherein the difference in speed between said first and second fluorescent intensifying screens is at least 0.2 log E.

10. The imaging assembly of claim 1 further comprising a metal intensifying screen in front of said first fluorescent intensifying screen.

11. The imaging assembly of claim 1 wherein the ratio of contrast of an image provided by said first radiographic silver halide film to the contrast of an image provided by said second radiographic silver halide film is at least 1.75.

12. The imaging assembly of claim 11 wherein the ratio of contrast of an image provided by said first radiographic silver halide film to the contrast of an image provided by said second radiographic silver halide film is from about 1.75 to about 2.5.

13. A method of providing a black-and-white image comprising exposing the radiographic imaging assembly of claim 1, and processing said first and second radiographic silver halide films, sequentially, with a black-and-white developing composition and a fixing composition, the processing being carried out within 90 seconds, dry-to-dry.

14. The method of claim 13 wherein said black-and-white developing composition is free of any photographic film hardeners.

15. The method of claim 14 being carried out for 60 seconds or less.

* * * * *